US007618921B2

(12) United States Patent
Mori

(10) Patent No.: US 7,618,921 B2
(45) Date of Patent: Nov. 17, 2009

(54) IMAGE FORMATION MATERIAL

(75) Inventor: Takahiro Mori, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 443 days.

(21) Appl. No.: 11/526,777

(22) Filed: Sep. 26, 2006

(65) Prior Publication Data

US 2007/0072774 A1 Mar. 29, 2007

(30) Foreign Application Priority Data

Sep. 29, 2005 (JP) ..... 2005-283930

(51) Int. Cl.
*B41M 5/26* (2006.01)

(52) U.S. Cl. ..... 503/226; 503/200

(58) Field of Classification Search ..... None
See application file for complete search history.

(56) References Cited

U.S. PATENT DOCUMENTS 5,595,955 A * 1/1997 Chang et al. ..... 503/201

FOREIGN PATENT DOCUMENTS

GB 2064801 A * 6/1981 ..... 503/207

* cited by examiner

*Primary Examiner*—Bruce H Hess
(74) *Attorney, Agent, or Firm*—Finnegan, Henderson, Farabow, Garrett & Dunner, L.L.P.

(57) ABSTRACT

An object of the present invention is to provide an image formation material exhibiting exposure visualization with excellent color development, and further to provide a printing plate material exhibiting excellent on-press developability, accompanied with excellent exposure visualization and printing durability. Also disclosed is an image formation material possessing a support and provided thereon, a thermosensitive image formation layer, wherein the thermosensitive image formation layer comprises water-insoluble particle (A), electron providing dye precursor (B) and electron accepting dye color developing agent (C), and at least one of the precursor (B) and the color developing agent (C) is provided on a surface of the particle (A).

5 Claims, No Drawings

IMAGE FORMATION MATERIAL

This application claims priority from Japanese Patent Application No. 2005-283930 filed on Sep. 29, 2005, which is incorporated hereinto by reference.

1. Technical Field

The present invention relates to an image formation material, and particularly to an image formation material usable for a computer to plate (CTP) system.

2. Background

In recent years, printing employing a CTP system has been conducted in printing industries, accompanied with the digitization of printing data. A printing plate material for CTP which is inexpensive, can be easily handled, and has a printing ability comparable with that of a so-called conventional PS plate, is demanded.

A versatile processless printing plate has been sought, which has a direct imaging (DI) property not requiring any development employing a specific developer, can be applied to a printing press with a direct imaging (DI) function, and can be handled in the same manner as in PS plates.

On the one hand, generally speaking, image layers of a PS plate and a CTP printing plate material subjected to development after exposure are colored, whereby contrast between image portions and the substrate surface (a grained aluminum support, for example) of non-image portions exposed after development is enhanced, exhibiting an excellent development visualization property. To put it plainly, a process of inspecting plates (visually or by a dedicated device) after development becomes possible.

In the CTP system, a process called "plate inspection" is still required in the present work flow, though the process might not be conducted in the future according to predictions.

In the case where a printing plate material is developed and punched to form holes for mounting on a plate cylinder of a printing press, register marks are read through employing a dedicated device and their correct positions are determined. Therefore, it is necessary to have contrast between image portions and non-image portions, which is possible to be read by a device.

Therefore, in the case of a thermal processless printing plate material free from development, a visualization property after recording an image, so-called exposure visualization is provided as a desired significant performance.

For example, Thermolite (registered trademark) produced by Agfa-Gevaert Group is provided as a DI processless printing plate material, but exhibits almost no exposure visualization since no "plate inspection" after exposure has been considered.

A thermal laser recording technique utilizing an emission wavelength of from near-infrared to infrared regions to form an image is mainly employed for processless printing plate image formation. A thermal processless printing plate material employing this technique is divided into three types; an ablation type printing plate material, an on-press development type printing plate material with a heat fusible image formation layer and a phase change type printing plate material.

Examples of the ablation type printing plate material include those disclosed in for example, Japanese Patent O.P.I. Publication Nos. 8-507727, 6-186750, 6-199064, 7-314934, 10-58636 and 10-244773.

These references disclose a printing plate material comprising a support, and provided thereon, a hydrophilic layer and a lipophilic layer, either of which is an outer layer. When a printing plate material is imagewise exposed in which the hydrophilic layer is an outer layer, the hydrophilic layer is removed by ablation to reveal the lipophilic layer, whereby an image is formed. This printing plate material has a problem that the exposure device is contaminated by the ablated material. In order to solve this problem, a printing plate material is proposed in which a water-soluble protective layer is provided on the hydrophilic layer so as to prevent the ablated material from scattering matter. This printing plate material is mounted on a plate cylinder of a printing press, and the ablated material is removed together with the protective layer on the plate cylinder.

It is possible to give an exposure visualization property to such a printing plate material employing an outer layer and a lower layer under the outer layer different in hues from each other. However, in order to realize the visualization, it is necessary to completely ablate and remove the outer layer. This can be realized by suctioning the ablated layer, for example, through a cleaner installed in an exposure device, but the cleaner install results in cost increase.

It is difficult to obtain good exposure visualization in the printing plate material described above having the protective layer in which hues of the outer layer and the lower layer are different, since there is problem that a layer to be ablated is not completely removed.

In order to solve the above problem, there has been proposed a printing plate material comprising a hydrophilic overcoat layer, which is capable of being removed on a printing press, containing at least 20% by weight of a cyanine infrared absorbing dye whose optical density varies due to exposure (disclosed in Japanese Patent O.P.I. Publication No. 2002-205466). This printing plate material gives good exposure image visualization, but it is difficult to avoid color contamination caused due to development on press, since the high dye content of the overcoat layer to be removed on a printing press exhibits a high color density in either exposed potions or unexposed portions, whether a color density of the layer increases or decreases due to exposure.

A method of using thermosensitive elements composed of an achromatic basic dye (dye precursor) and a color developing agent is known as a method to provide an exposure visualization property (refer to Patent Document 1). When such the dye precursor and color developing agent were mixed and dispersed to be used, there is a worry that coloring via not only heating, but also pressure is generated, whereby these were desired to be handled with care, resulting in insufficient storage stability.

Regarding a printing plate material possessing a thermosensitive image formation layer, known as a method to provide an exposure visualization property is a printing plate material possessing a microcapsule containing a dye precursor and a layer containing a color developing agent (refer to Patent Document 2), but there is a problem such that stain in non-image area tends to be caused during printing, resulting in insufficient printing durability.

Further, a printing plate material possessing an image formation layer containing a dye precursor coated with a solid resin is known (Patent Document 3), but there is another problem such that the enhanced color efficiency tends to be insufficient.

(Patent Document 1) Japanese Patent Examined Publication No. 2-56231

(Patent Document 2) Japanese Patent O.P.I. Publication No. 2000-225780

(Patent Document 3) Japanese Patent O.P.I. Publication No. 2005-88403

SUMMARY

It is an object of the present invention to provide an image formation material exhibiting exposure visualization with excellent color development, and further to provide a printing plate material exhibiting excellent on-press developability, accompanied with excellent exposure visualization and printing durability. Disclosed is an image formation material possessing a support and provided thereon, a thermosensitive image formation layer, wherein the thermosensitive image formation layer comprises water-insoluble particle (A), electron providing dye precursor (B) and electron accepting dye color developing agent (C), and the particle (A) has the precursor (B) or the color developing agent (C) provided on a surface of the particle (A).

DESCRIPTION OF THE PREFERRED EMBODIMENTS

The above object of the present invention is accomplished by the following structures.

(Structure 1) An image formation material possessing a support and provided thereon, a thermosensitive image formation layer, wherein the thermosensitive image formation layer comprises water-insoluble particle (A), electron providing dye precursor (B) and electron accepting dye color developing agent (C), and at least one of the precursor (B) and the color developing agent (C) is provided on a surface of the particle (A).

(Structure 2) The image formation material of Structure 1, wherein the precursor (B) is provided on the surface of the particle (A) and the color developing agent (C) is further provided on a surface of the precursor (B), or the color developing agent (C) is provided on the surface of the particle (A) and the precursor (B) is further provided on a surface of the color developing agent (C).

(Structure 3) The image formation material of Structure 2, wherein the particle (A) further has a barrier layer provided between the precursor (B) and the color developing agent (C).

(Structure 4) The image formation material of any one of Structures 1-3, wherein the particle (A) is a thermoplastic resin particle.

(Structure 5) The image formation material of any one of Structures 1-4, wherein the image formation material possesses a layer containing a light-to-heat conversion material on a side of the thermosensitive image formation layer provided on the support.

(Structure 6) The image formation material of any one of Structures 1-5, wherein the support has a hydrophilic surface, and the image formation material is a printing plate material.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

Next, the present invention will be described in detail.

The present invention has a feature concerning an image formation material possessing a support and provided thereon, a thermosensitive image formation layer, wherein the thermosensitive image formation layer comprises water-insoluble particle (A), electron providing dye precursor (B) and electron accepting dye color developing agent (C), and at least one of the precursor (B) and the color developing agent (C) is provided on a surface of the particle (A).

In the present invention, an image formation material exhibiting enhanced color efficiency and excellent exposure visualization can be provided by having an electron providing dye precursor, an electron accepting dye color developing agent, or an electron providing dye precursor and an electron accepting dye color developing agent provided specifically on a thermoplastic resin particle.

The water-insoluble particle of the present invention means a solid particle having a particle diameter of at most 10 μm. The particle may be in the porous form, or in the hollow form.

The particle diameter described above means a diameter of a circle having the largest area among circles having the same area as the projected area of a particle.

Water insolubility means that solubility with respect to 100 ml of water at 25° C. is at most 0.1 g.

One of the electron providing dye precursor and the electron accepting color developing agent is provided on the surface of the water-insoluble particle.

What is mentioned above means that one of electron providing dye precursor (B) and electron accepting color developing agent (C) adheres partly or entirely to the surface of the water-insoluble particle.

In this situation, it is specifically preferred that the water-insoluble particle is coated by electron providing dye precursor (B) or electron accepting color developing agent (C).

In this case, "coated" described above means that a particle surface area of at least 70% is coated by electron providing dye precursor (B) or electron accepting color developing agent (C), and it is preferable that a particle surface area of at least 90% is coated by electron providing dye precursor (B) or electron accepting color developing agent (C), but it is particularly preferable that a particle surface area of at least 99% is coated by electron providing dye precursor (B) or electron accepting color developing agent (C).

The water-insoluble particle having electron accepting color developing agent (C) provided on the surface of electron providing dye precursor (B) means that electron accepting color developing agent (C) is provided on electron providing dye precursor (B) adhering to the surface of the water-insoluble particle.

In the case of the above-described situation, it is preferable that the water-insoluble particle has a barrier layer provided on electron providing dye precursor (B) adhering to this particle, and electron accepting color developing agent (C) is provided on the barrier layer and adheres to this barrier layer.

Similarly to the above, when electron accepting color developing agent (C) adheres to the surface of the water-insoluble particle, it is preferable that the water-insoluble particle has a barrier layer provided on electron accepting color developing agent (C), and electron providing dye precursor (B) is provided on the barrier layer and adheres to this barrier layer.

The barrier layer performs a function of preventing electron providing dye precursor (B) from being brought into direct contact with electron accepting color developing agent (C).

It is particularly preferable that an average particle diameter of the water-insoluble particle contained in a thermosensitive image formation layer of the present invention is at least 0.1 μm and at most 1 μm in view of sensitivity and printing durability.

The average particle diameter was measured as described below.

The average particle diameter of the particles is measured according to the following measuring device. The average particle diameter is a peak value of a particle size distribution curve measured employing a laser diffraction/scatter particle size distribution measuring device (for example, LA-300 produced by HORIBA Co., Ltd.).

When one of the structural layers is a layer containing a light-to-heat conversion material, image formation via imagewise exposure employing laser light can be favorably applied specifically to a printing plate material in the present invention.

The electron providing dye precursor of the present invention is a compound capable of forming a dye via reaction with the electron accepting developing agent of the present invention.

A commonly known material used for thermosensitive recording paper sheets is usable as the electron providing dye precursor.

Examples of the various compounds include a triallylmethane based compound as represented by crystal violet lactone, a diphenylmethane based compound as represented by leucoauramine, a spiropyran-based compound, a fluoran based compound, a rhodamine lactam based compound, a carbazolylmethane based compound.

Compounds expressed by Formula (I) disclosed in Japanese Patent O.P.I. Publication No. 6-210947 are usable.

Specific examples of electron providing dye precursors used in the present invention are provided below.

(1) Triarylmethane based compounds such as 3, 3-bis(p-dimethylaminophenyl)-6-dimethylaminophthalide (crystal violet lactone), 3,3-bis(p-dimethylaminophenyl)phthalide, 3-(p-dimethylaminophenyl)-3-(1,2-dimethylindole-3-yl-)phthalide, 3-(p-dimethylaminophenyl)-3-(2-methylindole-3-yl)phthalide, 3-(p-dimethylamino phenyl)-3-(2-phenylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-5-dimethylaminophthalide, 3,3-bis(2-phenylindole-3-yl)-5-dimethylaminophthalide, 3-p-dimethylaminophenyl-3-(1-methylpyrrole-2-yl)-6-dimethylaminophthalide and so forth.

(2) Diphenylmethane based compounds such as 4,4'-bis-dimethylaminophenylbenzhydrylbenzylether, N-halophenylleucoauramine, 2,4,5-trichlorophenylleucoauramine, and so forth.

(3) Xanthene based compounds such as rhodamine B anilinolactam, rhodamine B-p-chloroanilinolactam, 3-diethylamino-7-dibenzylaminofluoran, 3-diethylamino-7-octylaminofluoran, 3-diethylamino-7-phenylfluoran, 3-diethylamino-7-chlorofluoran, 3-diethylamino-6-chloro-7-methylfluoran, 3-diethylamino-7-(3,4-dichloroanilino)fluoran, 3-diethylamino-7-(2-chloroanilino)fluoran, 3-diethylamino-6-methyl-7-anilinofluoran, 3-(N-ethyl-N-tolyl)amino-6-methyl-7-anilinofluoran, 3-piperidino-6-methyl-7-anilinofluoran, 3-(N-ethyl-N-tolyl)amino-6-methyl-7-phenethylfluoran, 3-diethylamino-7-(4-nitroanilino)fluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methy-N-cyclohexyl)amino-6-methyl-7-anilinofluoran, 3-(N-ethyl-N-tetrahydrofuryl)amino-6-methyl-7-anilinofluoran and so forth.

(4) Thiazin based compounds such as benzoylleucomethylene blue, p-nitrobenzoylleucomethylene blue and so forth.

(5) Spiro based compounds such as 3-methylspirodinaphthopyran, 3-ethylspirodinaphthopyran, 3,3-dichlorospironaphthopyran, 3-benzylspironaphthopyran, 3-methylnaphtho-(3-methoxybenzo)spiropyran, 3-propylspirobenzopyran and so forth.

These can be used singly or in combination with at least two kinds.

The electron accepting color developing agent is a compound capable of forming a dye via reaction with the foregoing dye precursor.

As the organic electron accepting color developing agent, commonly known color developing agents, which are used in conventional thermal recording paper and disclosed in Japanese Patent O.P.I. Publication Nos. 6-99663, 7-52551, and 8-258420, are preferably used.

For example, acidic compounds such as a phenol compound, a thiophenol compound, a thiourea derivative, an organic acid or its metal salt, and oxyesters are preferably usable.

Examples thereof include bisphenols such as 2,2-bis(4'-hydroxyphenyl)propane (called bisphenol A), 2,2-bis(4'-hydroxyphenyl)pentane, 2,2-bis(4'-hydroxy-3',5'-dichlorophenyl)propane, 1,1-bis(4'-hydroxyphenyl)cyclohexane, 2,2-bis(4'-hydroxyphenyl)hexane, 1,1-bis(4'-hydroxyphenyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxyphenyl)octane, 1,1-bis(4'-hydroxyphenyl)-2-methylpentane, 1,1-bis(4'-hydroxyphenyl)-2-ethylhexane, 1,1-bis(4'-hydroxyphenyl)dodecane, 1,4-bis(p-hydroxyphenylcumyl)benzene, 1,3-bis(p-hydroxyphenylcumyl)benzene, bis(p-hydroxyphenyl)sulfone, bis(3-allyl-4-hydroxyphenyl)sulfone, and bis(p-hydroxyphenyl)acetic acid benzyl ester; salicylic acid derivatives such as 3,5-di-α-methylbenzylsalicylic acid, 3,5-di-t-butylsalicylic acid, 3-α,α-dimethylbenzylsalicylic acid, 4-(β-p-dimethoxyphenoxyethoxy)salicylic acid and their polyvalent metal (particularly, zinc, aluminum is preferred) salts; oxybenzoic acid esters such as p-hydroxybenzoic acid benzyl ester, p-hydroxybenzoic acid 2-ethylhexyl ester, and β-resorcylic acid-(2-phenoxyethyl)ester; and phenols such as p-phenylphenol, 3,5-diphenylphenol, cumylphenol, 4-hydroxy-4'-isopropoxy-diphenyl sulfone, and 4-hydroxy-4'-phenoxy-diphenylsulfone, but are not limited thereto.

Examples of the water-insoluble particles in the present invention include metal oxide particles such as silica particles, titania particles and zirconia particles; metal compound particles such as metal carbide particles and metal nitride particles; inorganic particles such as clay mineral particles and the like; and hydrophilic organic particles such as wax particles, thermoplastic polymer particles, cross-linked polymer particles, alginate particles, chitosan particles and cellulose particles as the organic particles, but are not limited thereto.

These particles may be no-porous or porous, and the shape may also be spherical, acicular, spindle-shaped, octahedron-shaped, layer-strucrural, or irregular-form-shaped.

The particle diameter of the water-insoluble particle is preferably 10-5000 nm in view of resolution and dispersibility, and more preferably 20-2000 nm.

Of these, as the water-insoluble particles of the present invention, wax particles and thermoplastic resin particles are preferable, and wax particles are more preferable.

In this case, wax particles presumably perform a function as a sensitizer acting via coloring with a dye-precursor and a developing agent, when the particles are thermally fused.

Styrene, styreneacryl, styrene acrylonitrile, styrene butadiene and so forth are preferably usable as the thermoplastic resin particles.

Polyethylene, microcrystalline, carnauba wax, fatty acid amide (stearic acid amide, for example), fatty acid salt (stearic acid zinc, for example) and so forth are preferably usable-as the wax particles.

A method of attaching the dye precursor or the developing agent to the particle surface in the present invention is not particularly limited, but provided can be a method of adding a solution in which the dye precursor or the developing agent is dissolved in an appropriate organic solvent, into a prepared dispersion in which water-insoluble particles are dispersed in an aqueous medium, while stirring.

An organic solvent compatible with water is preferable as a usable organic solvent. Since the dye precursor and the developing agent each are dissolved in an organic solvent, but are hardly dissolved in a mixture solvent of water and the organic solvent, they each are precipitated in a water-insoluble particle dispersion. In this case, they each can be adhered to the surface of the water-insoluble particle, since they are easily precipitated onto the surface preferentially. As an addition method in this case, in order to prevent the dye precursor or the developing agent from precipitating separately as its particle alone without adhering to the surface of the water-insoluble particle, slow dripping for addition is preferred.

In the present invention, it is preferred that the developing agent adheres to the surface of the dye precursor provided on the water-insoluble particle via a barrier layer, and the dye precursor adheres also to the surface of the developing agent provided on the water-insoluble particle via a barrier layer.

In order to utilize the above-described barrier layer, after adhesion of the dye precursor or the developing agent, similarly to the above process, a barrier layer may be provided on the dye precursor or the developing agent, and further the developing agent or the dye precursor may adhere to the barrier layer.

The material usable as the barrier layer may be a material which is not soluble in water, but soluble in an organic solvent, and is not particularly limited thereto. Examples of the resin which is not soluble in water, but soluble in alcohol include methoxy-methylated nylon, shellac and so forth.

An alcohol-soluble infrared absorbing dye as described later is also usable as a barrier layer.

The content of the water-insoluble particles (to which the dye precursor or the developing agent adheres), based on the thermosensitive image formation layer is preferably 20-95% by weight, and more preferably 30-80% by weight.

The coating amount of the dye precursor (B) and the developing agent (C) in total, based on the weight of the water-insoluble particles is preferably 1-100% by weight in view of enhanced color efficiency, and more preferably 5-50% by weight.

(Light-to-heat Conversion Material)

It is preferred that the image formation material of the present invention possesses a layer containing a light-to-heat conversion material on the side of a thermosensitive image formation layer provided on a support. It is also preferred that the layer containing a light-to-heat conversion material is the thermosensitive image formation layer or a layer adjacent thereto.

Examples of dye and pigment as the light-to-heat conversion material are listed below.

As the dye, examples of the infrared absorbing dye include organic compounds such as a cyanine dye as a conventional infrared absorbing dye, a chloconium dye, a polymethine dye, an azulenium dye, a squalenium dye, a thiopyrylium dye, a naphthoquinone dye, an anthraquinone dye and the like, and organometallic complexes such as a phthalocyanine based compound, a naphthalocyanine based compound, an azo based compound, a thioamide based compound, a dithiol based compound, an indoaniline based compound and the like. Specifically, the light-to-heat conversion materials include compounds disclosed in Japanese Patent O.P.I. Publication Nos. 63-139191, 64-33547, 1-160683, 1-280750, 1-293342, 2-2074, 3-26593, 3-30991, 3-34891, 3-36093, 3-36094, 3-36095, 3-42281, 3-97589 and 3-103476. These compounds may be used singly or in combination.

Also, preferably usable are the compounds disclosed in the following patent documents, for example, Japanese Patent O.P.I. Publication Nos. 11-240270, 11-265062, 2000-309174, 2002-49147, 2001-162965, 2002-144750, and 2001-219667.

As the pigment, carbon, graphite, a metal and a metal oxide are usable.

As the carbon, furnace black or acetylene black is particularly usable. A particle size (d50) of at most 100 nm is preferable, and that of at most 50 nm is more preferable.

Regarding the graphite, a graphite particle diameter is at most 500 nm, more preferably. 100 nm, and more preferably 50 nm.

Regarding the metal, any kind of metal particles are usable, provided that a metal particle diameter is at most 500 nm, more preferably 100 nm, and more preferably 50 nm. Concerning the shape, any shape such as a spherical shape, a flaky shape or an acicular shape may also be allowed to be used. Colloidal metal particles made of Ag, Au or such are particularly preferable.

As the metal oxide, usable is material exhibiting black in the visible light range, or material itself exhibiting an electrically conductive or semiconductive property.

As the former metal oxide, a black iron oxide or a black complex metal oxide containing at least two kinds of metals is usable.

As the latter metal oxide, $SnO_2$ doping Sb (ATO), $In_2O_3$ adding Sn (ITO), $TiO_2$, and TiO or TiON reducing $TiO_2$ (generally titanium black) are usable. A core material such as $BaSO_4$, $TiO_2$, $9Al_2O_3.2B_2O$ or $K_2O.nTiO_2$ coated by such the metal oxide is also usable. Further, a particle diameter of these is at most 500 nm, preferably 100 nm, and more preferably 50 nm.

Of these light-to-heat conversion materials, a black iron oxide or a black complex metal oxide containing at least two kinds of metals is usable as the more preferable material.

The black iron oxide ($Fe_3O_4$). particles have an average particle diameter of 0.01-1 μm, and an acicular ratio (major axis length/minor axis length) of preferably 1-1.5. It is preferred that the black iron oxide particles are substantially spherical ones (having an acicular ratio of 1) or octahedral ones (having an acicular ratio of about 1.4).

Examples of the black iron oxide particles include for example, TAROX series produced by Titan Kogyo K.K. Examples of the spherical particles include BL-100 (having a particle size of 0.2-0.6 μm), and BL-500 (having a particle size of 0.3-1.0 μm). Examples of the octahedral particles include ABL-203 (having a particle size of 0.4-0.5 μm), ABL-204 (having a particle size of 0.3-0.4 μm), ABL-205 (having a particle size of 0.2-0.3 μm), and ABL-207 (having a particle size of 0.2 μm).

The black iron oxide particles may be surface-coated with inorganic compounds such as $SiO_2$. Examples of such black iron oxide particles include spherical particles BL-200 (having a particle size of 0.2-0.3 μm) and octahedral particles ABL-207A (having a particle size of 0.2 μm), each having been surface-coated with $SiO_2$.

Typical examples of the black complex metal oxides include complex metal oxides comprising at least two kinds selected from Al, Ti, Cr, Mn, Fe, Co, Ni, Cu, Zn, Sb, and Ba. These can be prepared according to the methods disclosed in Japanese Patent O.P.I. Publication Nos. 9-27393, 9-25126, 9-237570, 9-241529 and 10-231441.

The complex metal oxide used in the present invention is preferably a complex Cu—Cr—Mn type metal oxide or a Cu—Fe—Mn type metal oxide. The Cu—Cr—Mn type metal oxides are preferably subjected to the treatment disclosed in Japanese Patent O.P.I. Publication Nos. 8-27393 in order to reduce isolation of a hexavalent chromium ion. These complex metal oxides exhibit a high color density and a high light-to-heat conversion efficiency as compared with another metal oxide.

The primary average particle diameter of these complex metal oxides is preferably 0.005-1.0 μm, and more preferably 0.01-0.5 μm. The primary average particle diameter of 0.005-1.0 μm improves a light-to-heat conversion efficiency relative to the addition amount of the particles, and the primary average particle diameter of 0.01-0.5 μm further improves a light-to-heat conversion efficiency relative to the addition amount of the particles.

The light-to-heat conversion efficiency relative to the addition amount of the particles depends on a dispersity of the particles, and the well-dispersed particles have a high light-to-heat conversion efficiency. Accordingly, these complex metal oxide particles are preferably dispersed according to a known dispersing method, separately to a dispersion liquid (paste), before being added to a coating liquid for the particle containing layer.

The metal oxides having a primary average particle diameter of less than 0.005 μm are not preferred since they are difficult to disperse. A dispersant is optionally used for dispersion. The addition amount of the dispersant is preferably 0.01-5% by weight, and more preferably 0.1-2% by weight, based on the weight of the complex metal oxide particles.

It is preferred to employ dye in the present invention, and further preferred to utilize dye with less coloring in the visible light range.

An image formation material of the present invention generates formation of a visible image via imagewise heating to form images.

(Support)

The support of the present invention is a plate or film capable of carrying a structural layer comprising a thermosensitive image formation layer, and those well known in the art as substrates for printing plates can be used for the support of the present invention.

Examples of the support include a metal plate, a plastic film sheet, a paper sheet treated with polyolefin, and composite sheets such as laminates thereof.

The thickness of the support is not specifically limited, provided that the support is installable in a printing press as a printing material, and a thickness of 50-500 μm is preferable in view of easy handling.

Examples of the metal plate used as a support include iron, stainless steel, and aluminum. Aluminum is especially preferable in its gravity and stiffness. Aluminum is ordinarily used after degreased with an alkali, an acid or a solvent to remove oil on the surface, which has been used when rolled and wound around a spool.

The degreasing is carried out preferably employing an aqueous alkali solution. In order to increase adhesion between the support and a coating layer, it is preferred that the surface of the support is subjected to adhesion increasing treatment or is coated with a subbing layer. For example, the support is immersed in a solution containing silicate or a coupling agent such as a silane coupling agent, or the support is coated with the solution and then sufficiently dried. Anodizing treatment is considered to be one kind of adhesion increasing treatment, and can be used. The anodizing treatment and the immersing or coating treatment described above can be used in combination.

As the support of the present invention, a support having a hydrophilic layer is preferable in the case of using it as a printing plate material. An aluminum plate (so-called grained aluminum plate subjected to hydrophilic treatment), which has been surface-roughened with a commonly known method, or a plastic film having a hydrophilic layer is also usable as a support having a hydrophilic layer.

Examples of the plastic film include a polyethylene terephthalate film, a polyethylene naphthalate film, a polyimide film, a polyamide film, a polycarbonate film, a polysulfone film, a polyphenylene oxide film, and a cellulose ester film.

The polyethylene terephthalate film or the polyethylene naphthalate film is preferable as a support usable in the present invention. In order to increase adhesion between the support and a coating layer, it is preferred that the surface of the plastic film is subjected to adhesion increasing treatment or is coated with a subbing layer. Examples of the adhesion increasing treatment include corona discharge treatment, flame treatment, plasma treatment and UV light irradiation treatment. Examples of the subbing layer include a layer containing gelatin or latex. The subbing layer can contain a known organic or inorganic electrically conductive material.

A support with a known back-coating layer coated can be used in order to control slippage of the rear surface of the support, for example, in order to reduce friction between the rear surface and a plate cylinder of a printing press.

(Hydrophilic Layer)

The hydrophilic layer is a layer capable of forming a non-image portion repelling printing ink during printing. The hydrophilic layer in the present invention means one provided on the support or a surface layer of the support whose surface is subjected to hydrophilization treatment. The hydrophilic layer contains a hydrophilic material.

As the printing plate material usable in the present invention, there is a printing plate material comprising a support having a hydrophilic layer. The hydrophilic layer may be a single layer or plural layers.

The coating amount of the hydrophilic layer is preferably 0.1-10 g/m$^2$, and more preferably 0.2-5 g/m$^2$.

Material used in the hydrophilic layer is preferably a water-insoluble hydrophilic material, and especially preferably a metal oxide.

The metal oxide is preferably metal oxide particles. Examples of the metal oxide particles include colloidal silica particles, an alumina sol, a titania sol and another metal oxide sol. The metal oxide particles may have any shape such as spherical, needle-like, and feather-like shape. The average particle diameter is preferably 3-100 nm, and plural kinds of metal oxide each having a different size may be used in combination. The surface of the particles may be subjected to surface treatment.

The above metal oxide particles can be used as a binder, utilizing its layer forming ability. The metal oxide particles are suitably used in a hydrophilic layer since they minimize lowering of the hydrophilicity of the layer as compared with an organic compound binder.

Among the above-mentioned, colloidal silica is particularly preferred. The colloidal silica has a high layer forming ability under a drying condition with a relative low temperature, and can provide a good layer strength even in a layer containing not less than 91% by weight of a material containing no carbon atom.

It is preferred that the colloidal silica is necklace-shaped colloidal silica or colloidal silica particles having an average particle diameter of at most 20 nm. Further, it is preferred that the colloidal silica provides an alkaline colloidal silica solution as a colloid solution.

The necklace-shaped colloidal silica is a generic term of an aqueous dispersion system of spherical silica having a primary particle diameter of the order of nm. The necklace-shaped colloidal silica to be used in the present invention means a "pearl necklace-shaped" colloidal silica formed by connecting spherical colloidal silica particles each having a primary particle diameter of 10-50 μm so as to attain a length of 50-400 nm. The term of "pearl necklace-shaped" means that the image of connected colloidal silica particles is like to the shape of a pearl necklace. The bonding between the silica particles forming the necklace-shaped colloidal silica is considered to be —Si—O—Si—, which is formed by dehydration of —SiOH groups located on the surface of the silica particles. Concrete examples of the necklace-shaped colloidal silica include Snowtex-PS series produced by Nissan Kagaku Kogyo, Co., Ltd.

As the products, there are Snowtex-PS-S (the average particle diameter in the connected state is approximately 110 nm), Snowtex-PS-M (the average particle diameter in the connected state is approximately 120 nm) and Snowtex-PS-L (the average particle diameter in the connected state is approximately 170 nm). Acidic colloidal silicas corresponding to each of the above-mentioned are Snowtex-PS-S-O, Snowtex-PS-M-O and Snowtex-PS-L-O, respectively.

The necklace-shaped colloidal silica is preferably used in a hydrophilic layer as a porosity providing material for hydrophilic matrix phase, and porosity and strength of the layer can be secured by its addition to the layer.

Among them, the use of Snowtex-PS-S, Snowtex-PS-M or Snowtex-PS-L, each being alkaline colloidal silica particles, is particularly preferable since the strength of the hydrophilic layer is increased and occurrence of background contamination is inhibited even when a lot of prints are printed.

It is known that the binding force of the colloidal silica particles is become larger with decrease of the particle diameter. The average particle diameter of the colloidal silica particles to be used in the present invention is preferably at most 20 nm, and more preferably 3-15 nm. As above-mentioned, the alkaline colloidal silica particles show the effect of inhibiting occurrence of the background contamination. Accordingly, the use of the alkaline colloidal silica particles is particularly preferable.

Examples of the alkaline colloidal silica particles having the average particle diameter within the foregoing range include Snowtex-20 (average particle diameter: 10-20 nm), Snowtex-30 (average particle diameter: 10-20 nm), Snowtex-40 (average particle diameter: 10-20 nm), Snowtex-N (average particle diameter: 10-20 nm), Snowtex-S (average particle diameter: 8-11 nm) and Snowtex-XS (average particle diameter: 4-6 nm), each produced by Nissan Kagaku Co., Ltd.

The colloidal silica particles having an average particle diameter of at most 20 nm, when used together with the necklace-shaped colloidal silica as described above, is particularly preferred, since appropriate porosity of the layer is maintained and the layer strength is further increased.

The ratio of the colloidal silica particles having an average particle diameter of at most 20 nm to the necklace-shaped colloidal silica is preferably 95/5-5/95, more preferably 70/30-20/80, and most preferably 60/40-30/70.

The hydrophilic layer used as a printing plate material in the present invention preferably contains porous metal oxide particles as metal oxides. Examples of the porous metal oxide particles include porous silica particles, porous aluminosilicate particles or zeolite particles.

The porous silica particles are ordinarily produced by a wet method or a dry method. By the wet method, the porous silica particles can be obtained by drying and pulverizing a gel prepared by neutralizing an aqueous silicate solution, or pulverizing the precipitate formed by neutralization. By the dry method, the porous silica particles are prepared by combustion of silicon tetrachloride together with hydrogen and oxygen to precipitate silica. The porosity and the particle diameter of such particles can be controlled by variation of the production conditions.

The porous silica particles prepared from the gel by the wet method is particularly preferred.

The porous aluminosilicate particles can be prepared by the method described in, for example, Japanese Patent O.P.I. Publication No. 10-71764. Thus prepared aluminosilicate particles are amorphous complex particles synthesized by hydrolysis of aluminum alkoxide and silicon alkoxide as the major components. The particles can be synthesized so that the ratio of alumina to silica in the particles is within the range of from 1:4 to 4:1. Complex particles composed of three or more components prepared by an addition of another metal alkoxide may also be used in the present invention. In such a particle, the porosity and the particle diameter can be controlled by adjustment of the production conditions.

The porosity of the particles is preferably at least 1.0 ml/g, more preferably at least 1.2 ml/g, and most preferably of 1.8-2.5 ml/g, in terms of pore volume before the dispersion.

The particle diameter of the particles dispersed in the hydrophilic layer (or in the dispersed state before formed as a layer) is preferably at most 1 μm, and more preferably at most 0.5 μm.

The diameter of the porous inorganic particles in the hydrophilic layer is preferably at most 1 μm, and more preferably at most 0.5 μm.

The hydrophilic layer of the printing plate material in the present invention can contain layer structural clay mineral particles as a metal oxide. Examples of the layer structural clay mineral particles include a clay mineral such as kaolinite, halloysite, talk, smectite such as montmorillonite, beidellite, hectorite and saponite, vermiculite, mica and chlorite; hydrotalcite; and a layer structural polysilicate such as kanemite, makatite, ilerite, magadiite and kenyte. Among them, ones having a higher electric charge density of the unit layer are higher in the polarity and in the hydrophilicity. Preferable charge density is at least 0.25, more preferably at least 0.6. Examples of the layer structural mineral particles having such a charge density include smectite having a negative charge density of 0.25-0.6 and bermiculite having a negative charge density of 0.6-0.9. Synthesized fluorinated mica is preferable since one having a stable quality, such as the particle diameter, is available. Among the synthesized fluorinated mica, swellable one is preferable and one freely swellable is more preferable.

An intercalation compound of the foregoing layer structural mineral particles such as a pillared crystal, or one treated by an ion exchange treatment or a surface treatment such as a silane coupling treatment or a complication treatment with an organic binder is also usable.

The planar structural mineral particles are preferably in the plate form, and have an average particle diameter (an average of the largest particle length) of preferably at most 20 μm, and an average aspect ratio (the largest particle length/the particle thickness) of preferably at least 20, and more preferably at least 50, in a state contained in the layer including the case that the particles are subjected to a swelling process and a dispersing layer-separation process. The particles more preferably have an average particle diameter of preferably at most 5 μm, and an average aspect ratio of at least 50, and still more preferably have an average particle diameter of preferably at most 1 μm, and an average aspect ratio of at least 50. When the particle diameter is within the foregoing range, continuity to the parallel direction, which is a trait of the layer structural particle, and softness, are given to the coated layer so that a strong dry layer in which a crack is difficult to be formed can be obtained. The coating solution containing the layer structural clay mineral particles in a large amount can minimize particle sedimentation due to a viscosity increasing effect.

The content of the layer structural clay mineral particles is preferably 0.1-30% by weight, and more preferably 1-10% by weight, based on the total weight of the layer. Particularly, the addition of the swellable synthesized fluorinated mica or smectite is effective if the adding amount is small. The layer structural clay mineral particles may be added in the form of powder to a coating liquid, but it is preferred that gel of the particles which is obtained by being swelled in water, is added to the coating liquid in order to obtain a good dispersity according to an easy coating liquid preparation method which requires no dispersion process comprising dispersion due to media.

An aqueous solution of a silicate is also usable as another additive to the hydrophilic layer in the present invention. An alkali metal silicate such as sodium silicate, potassium silicate or lithium silicate is preferable, and the $SiO_2/M_2O$ is preferably selected so that the pH value of the coating liquid after addition of the silicate does not exceed 13 in order to prevent dissolution of the inorganic particles.

An inorganic polymer or an inorganic-organic hybrid polymer prepared by a sol-gel method employing a metal alkoxide. Known methods described in S. Sakka "Application of Sol-Gel Method" or in the publications cited in the above publication can be applied to prepare the inorganic polymer or the inorganic-organic hybrid polymer by the sol-gel method.

In the present invention, the hydrophilic layer may contain a hydrophilic organic resin.

Examples of the hydrophilic organic resin include polysaccharides, polyethylene oxide, polypropylene oxide, polyvinyl alcohol, polyethylene glycol (PEG), polyvinyl ether, a styrene-butadiene copolymer, a conjugation diene polymer latex of methyl methacrylate-butadiene copolymer, an acryl polymer latex, a vinyl polymer latex, polyacrylamide, and polyvinyl pyrrolidone.

A cationic resin may also be contained in the hydrophilic layer. Examples of the cationic resin include a polyalkylenepolyamine such as a polyethyleneamine or polypropylenepolyamine or its derivative, an acryl resin having a tertiary amino group or a quaternary ammonium group and diacrylamine. The cationic resin may be added in a form of fine particles. Examples of such particles include the cationic microgel described in Japanese Patent O.P.I. Publication No. 6-161101.

In the present invention, it is preferred that the hydrophilic organic resin contained in the hydrophilic layer is a water soluble resin, and at least a part of the resin exists in the hydrophilic layer in a state capable of being dissolved in water.

The water-soluble resin contained in the hydrophilic layer is preferably a saccharide.

As the saccharides, oligosaccharide detailed later can be used, but polysaccharides are preferably used.

As the polysaccharide, starches, celluloses, polyuronic acid and pullulan can be used. Among them, a cellulose derivative such as a methyl cellulose salt, a carboxymethyl cellulose salt or a hydroxyethyl cellulose salt is preferable, and a sodium or ammonium salt of carboxymethyl cellulose is more preferable.

These polysaccharides can form a preferred surface shape of the hydrophilic layer.

The surface of the hydrophilic layer preferably has a convexoconcave structure having a pitch of 0.1-50 μm such as the grained aluminum surface of an aluminum PS plate. The water retention ability and the image maintaining ability are raised by such a convexoconcave structure of the surface.

Such a convexoconcave structure can also be formed by adding in an appropriate amount a filler having a suitable particle diameter to the coating liquid of the hydrophilic layer. However, the convexoconcave structure is preferably formed by coating a coating liquid for the hydrophilic layer containing the alkaline colloidal silica and the water-soluble polysaccharide so that the phase separation occurs at the time of drying the coated liquid, whereby a structure is obtained which provides a good printing performance.

The shape of the convexoconcave structure such as the pitch and the surface roughness thereof can be suitably controlled by the kinds and the adding amount of the alkaline colloidal silica particles, the kinds and the adding amount of the water-soluble polysaccharide, the kinds and the adding amount of another additive, a solid concentration of the coating liquid, a wet layer thickness or a drying condition.

The pitch in the convexoconcave structure is preferably 0.2-30 μm, and more preferably 0.5-20 μm. A multi-layered convexoconcave structure may be formed in which a convexoconcave structure with a smaller pitch is formed on one with a larger pitch.

The hydrophilic layer has a surface roughness Ra of preferably 100-1000 nm, and more preferably 150-600 nm.

The thickness of the hydrophilic layer is 0.01-50 μm, preferably 0.2-10 μm, and more preferably 0.5-3 μm.

A water-soluble surfactant may be added for improving the coating ability of the coating liquid for the hydrophilic layer in the present invention. A Si-containing surfactant and an F-containing surfactant are preferably used. The Si-containing surfactant is especially preferred in that it minimizes printing contamination.

The content of the surfactant is preferably 0.01-3% by weight, and more preferably 0.03-1% by weight based on the total weight of the hydrophilic layer (or the solid content of the coating liquid).

The hydrophilic layer of the present invention can contain a phosphate. Since a coating liquid for the hydrophilic layer is preferably alkaline, the phosphate to be added to the hydrophilic layer is preferably sodium phosphate or sodium monohydrogen phosphate. The addition of the phosphate provides improved reproduction of dots at shadow portions. The content of the phosphate is preferably 0.1-5% by weight, and more preferably 0.5-2% by weight in terms of amount excluding hydrated water.

The preferred hydrophilic support is an aluminum plate whose surface has been subjected to hydrophilization treatment, and cab be obtained by surface-roughening the aluminum plate.

It is preferable that the aluminum plate is subjected to degreasing treatment for removing rolling oil prior to surface roughening (graining). The degreasing treatments include degreasing treatment employing solvents such as trichlene and thinner, and an emulsion degreasing treatment employing an emulsion such as kerosene or triethanol. It is also possible to use an aqueous alkali solution such as caustic soda for the degreasing treatment. When an aqueous alkali solution such as caustic soda is used for the degreasing treatment, it is possible to remove soils and an oxidized film which can not be removed by the above-mentioned degreasing treatment alone. When an aqueous alkali solution such as caustic soda is used for the degreasing treatment, the resulting support is preferably subjected to desmut treatment in an aqueous solution of an acid such as phosphoric acid, nitric acid, sulfuric acid, chromic acid, or a mixture thereof, since smut is produced on the surface of the support. The surface roughening methods include a mechanical surface roughening method and an electrolytic surface roughening method electrolytically etching the support surface.

Though there is no restriction for the mechanical surface roughening method, a brushing roughening method and a honing roughening method are preferable.

Though there is no restriction for the electrolytic surface roughening method, a method, in which the support is electrolytically surface roughened in an acidic electrolytic solution, is preferred.

After the support has been electrolytically surface roughened, it is preferably dipped in an acid or an aqueous alkali solution in order to remove aluminum dust, etc. produced in the surface of the support. Examples of the acid include sulfuric acid, persulfuric acid, hydrofluoric acid, phosphoric acid, nitric acid and hydrochloric acid, and examples of the alkali include sodium hydroxide and potassium hydroxide. Among those mentioned above, the aqueous alkali solution is preferably used. The dissolution amount of aluminum in the support surface is preferably 0.5-5 $g/m^2$. After the support has been dipped in the aqueous alkali solution, it is preferable for the support to be dipped in an acid such as phosphoric acid, nitric acid, sulfuric acid and chromic acid, or in a mixed acid thereof, for neutralization.

The mechanical surface roughening and electrolytic surface roughening may be carried out singly, and the mechanical surface roughening followed by the electrolytic surface roughening may be carried out.

After the surface roughening, anodizing treatment may be carried out. There is no restriction in particular for the method of anodizing treatment used in the present invention, and known methods can be used. The anodizing treatment forms an anodization film on the surface of the support.

The support which has been subjected to anodizing treatment is optionally subjected to sealing treatment. For the sealing treatment, it is possible to use known methods using hot water, boiling water, steam, a sodium silicate solution, an aqueous dichromate solution, a nitrite solution and an ammonium acetate solution.

After the above treatment, the support is suitably undercoated with a water soluble resin such as polyvinyl phosphonic acid, a polymer or copolymer having a sulfonic acid in the side chain, or polyacrylic acid; a water soluble metal salt such as zinc borate; a yellow dye; an amine salt; and so on, for hydrophilization treatment. The sol-gel treatment support disclosed in Japanese Patent O.P.I. Publication No. 5-304358, which has a functional group capable of causing addition reaction by radicals as a covalent bond, is suitably used.

(Thermosensitive Image Formation Layer)

The thermosensitive image formation layer is a layer capable of forming an image via heating, and contains a heat melting material, a heat fusible material or a material exhibiting a property changing from hydrophilicity to hydrophobicity via heating (hydrophobic precursor). As a heating method, there is a method of using a heat source or a method of using heat generated via laser exposure and so forth, but the method of forming an image by using heat generated via laser exposure and so forth is preferable. As one of the preferred embodiments for an image formation layer of the present invention, the image formation layer comprising a hydrophobic precursor is exemplified.

As a hydrophobic precursor, employed is a polymer capable of exhibiting a property changing from hydrophilicity (water-soluble or water-swellable) to hydrophobicity via heating. Specifically, a polymer having an aryldiazosulfonate unit as disclosed in Japanese Patent O.P.I. Publication No. 2000-56449, for example, is provided as the hydrophobic precursor.

It is preferred that the heat melting material and the heat fusible material are used as their particles.

The heat melting particles are particles having low viscosity, and made of a material commonly classified as wax. The heat melting particles preferably have a softening point of 40-120° C. and a melting point of 60-150° C., and more preferably have a softening point of 40-100° C. and a melting point of 60-120° C. In the case of a melting point less than 60° C., a storage problems is generated, and in the case of a melting point exceeding 300° C., ink receptive sensitivity drops.

Examples of the usable material include paraffin, polyolefin, polyethylene wax, microcrystalline wax, fatty acid based wax and so forth. The molecular weight thereof is approximately 800-10,000. A polar group such as a hydroxyl group, an ester group, a carboxyl group, an aldehyde group or a peroxide group can be introduced via oxidation of the wax to increase the emulsification ability.

Further, stearoamide, linolenamide, laurylamide, myristylamide, hardened cattle fatty acid amide, palmitamide, oleicamide, rice bran oil fatty acid amide, palm oil fatty acid amide, a methylol compound of the above-mentioned amide compounds, methylenebissteastearoamide and ethylenebissteastearoamide may be added into the wax in order to lower the softening point or to improve the workability. A cumarone-indene resin, a rosin-modified phenol resin, a terpene-modified phenol resin, a xylene resin, a ketone resin, an acryl resin, an ionomer and a copolymer of these resins may also be usable.

Among them, one of polyethylene wax, microcrystalline wax, and fatty acid based wax is preferably contained. A highly sensitive image formation can be performed since these materials each have a relatively low melting point and low viscosity. Since each of these materials shows lubricity, the layer damage is minimized when a shearing force is applied to the surface layer of the printing plate precursor, and resistance to stain during printing, which may be caused by scratch, is further enhanced.

The heat melting particles are preferably dispersible in water. The average particle diameter thereof is preferably 0.01-10 μm, and more preferably 0.1-3 μm in view of on-press developability and resolution and so forth.

The composition of the heat melting particle may vary continuously from the interior to the surface of the particle. The particle may also be coated with a different material.

A commonly known microcapsule formation method or a sol-gel method is usable for coating particles.

The content of heat melting particles in the thermosensitive image formation layer is preferably 1-90% by weight, and more preferably 5-80% by weight.

The heat fusible particles used in the present invention include thermoplastic and hydrophobic polymer particles. Although there is no specific limitation to the upper limit of the softening point of the polymer particles, the softening point is preferably lower than the decomposition temperature of the polymer particles. The weight average molecular weight (Mw) of the polymer is preferably in the range of 10,000-1,000,000.

Examples of the polymer constituting the polymer particles include a diene(co)polymer such as polypropylene, polybutadiene, polyisoprene or an ethylene-butadiene copolymer; a synthetic rubber such as a styrene-butadiene copolymer, a methyl methacrylate-butadiene copolymer or an acrylonitrile-butadiene copolymer; (meth)acrylic acid ester or a (meth)acrylic acid (co)polymer such as polymethyl methacrylate, a methyl methacrylate-(2-ethylhexyl)acrylate copolymer, a methyl methacrylate-methacrylic acid copolymer, a methyl acrylate-(N-methylolacrylamide) copolymer or polyacrylonitrile; a vinyl ester (co)polymer such as polyvinyl acetate, a vinyl acetate-vinyl propionate copolymer or a vinyl acetate-ethylene copolymer; a vinyl acetate-(2-ethylhexylacrylate)copolymer, polyvinyl chloride, polyvinylidene chloride, polystyrene, and a copolymer thereof of these, the (meth)acrylic acid ester, the (meth)acrylic acid (co)polymer, the vinyl ester (co)polymer, the polystyrene and the synthetic rubbers are preferable.

The polymer particles may be prepared from a polymer synthesized by any of known methods such as an emulsion polymerization method, a suspension polymerization method, a solution polymerization method and a gas phase polymerization method. The particles of the polymer synthesized by the solution polymerization method or the gas phase polymerization method can be produced by a method in which an organic solution of the polymer is sprayed into an inactive gas and dried, and another method in which the polymer is dissolved in a water-immiscible solvent, then the resulting solution is dispersed in water or an aqueous medium followed by removing the solvent by distillation. In both of the methods, a surfactant such as sodium lauryl sulfate, sodium dodecylbenzenesulfate or polyethylene glycol, or a water-soluble resin such as poly(vinyl alcohol) may be optionally used as a dispersant or a stabilizer.

The heat fusible particles are preferably dispersible in water. The average particle diameter of the heat fusible particles is preferably 0.01 to 10 μm, and more preferably 0.1 to 3 μm in view of on-press developability, resolution and so forth.

Further, the composition of the heat fusible particle may vary continuously from the interior to the surface of the particle. The particle may be coated with a different material.

A microcapsule formation method or a sol-gel method is usable for coating particles.

The content of thermoplastic particles in the layer is preferably 1-90% by weight, based on the total weight of the layer, and more preferably 5-80% by weight.

Provided as microcapsules are those encapsulating hydrophobic materials disclosed in, for example, Japanese Patent O.P.I. Publication Nos. 2002-2135 and 2002-19317.

The average microcapsule diameter is preferably 0.1-10 μm, more preferably 0.3-5 μm, and still more preferably 0.5-3 μm.

The thickness of the microcapsule wall is preferably 1/100-1/5 of the average microcapsule diameter, and more preferably 1/50-1/10.

The microcapsule content in the image formation layer is preferably 5-100% by weight, based on the total weight of the image formation layer, more preferably 20-95% by weight, and still more preferably 40-90% by weight.

As the material for a microcapsule wall, known materials can be used. As a method of manufacturing microcapsules, known methods can also be used. The material for a microcapsule wall and the manufacturing method of a microcapsule wall which are disclosed in "New Edition Microcapsule, Its Manufacturing Method, Properties and Application" (written by Tamotsu Kondo and Masumi Koishi), published by Sankyo Shuppan Co., Ltd., or are disclosed in literatures citing it.

One of the preferred embodiments in the present invention is that particles as the foregoing hydrophobic precursor are water-insoluble particles (A) of the present invention.

[Other Compounds Optionally Contained in the Image Formation Layer]

The image formation layer in the present invention can further contain the following compounds.

The image formation layer can further contain the light-to-heat conversion material described above. The image formation layer preferably contains a material with less coloring in the visible light range.

The image formation layer can contain water-soluble resins or water-dispersible resins. Water soluble resins or water dispersible resins include oligosaccharides, polysaccharides, polyethylene oxide, polypropylene oxide, polyvinyl alcohol, polyethylene glycol (PEG), polyvinyl ether, a styrene-butadiene copolymer, a conjugation diene polymer latex of methyl methacrylate-butadiene copolymer, an acryl polymer latex, a vinyl polymer latex, polyacrylic acid, polyacrylic acid salts, polyacrylamide, and polyvinyl pyrrolidone.

Among these, oligosaccharides, polysaccharides or polyacrylic acid, polyacrylic acid salts (sodium salt, etc.), and polyacrylamide are preferred.

Examples of the oligosaccharides include raffinose, trehalose, maltose, galactose, sucrose, and lactose. Among these, trehalose is preferred.

Examples of the polysaccharides include starches, celluloses, polyuronic acid and pullulan. Among these, cellulose derivatives such as a methyl cellulose salt, a carboxymethyl cellulose salt and a hydroxyethyl cellulose salt are preferred, and a sodium or ammonium salt of carboxymethyl cellulose is more preferred.

The molecular weight of polyacrylic acid, polyacrylic acid salts (sodium salt, etc.), and polyacrylamide has preferably a molecular weight of 3,000-5,000,000, and more preferably a molecular weight of 5,000-1,000,000.

A water-soluble surfactant may be contained in the image formation layer. A silicon atom-containing surfactant and a fluorine atom-containing surfactant can be used. The silicon atom-containing surfactant is especially preferred in that it minimizes printing contamination. The content of the surfactant is preferably 0.01-3.0% by weight, and more preferably 0.03-1.0% by weight based on the total weight of the image formation layer (or the solid content of the coating liquid).

The image formation layer may contain an acid (phosphoric acid or acetic acid) or an alkali (sodium hydroxide, silicate, or phosphate) to adjust pH.

The coating amount of the image formation layer is 0.01-10 $g/m^2$, preferably 0.1-3 $g/m^2$, and more preferably 0.2-2 $g/m^2$.

(Protective Layer)

A protective layer can be provided on the image formation layer.

As a material used in the protective layer, the water-soluble resin or the water-dispersible resin described above can be preferably used.

The protective layer in the present invention may be a hydrophilic overcoat layer disclosed in Japanese Patent O.P.I. Publication Nos. 2002-19318 and 2002-86948.

The coating amount of the protective layer is 0.01-10 g/m$^2$, preferably 0.1-3 g/m$^2$, and more preferably 0.2-2 g/m$^2$.

(On-press Development)

This is a preferred embodiment to develop an image formation material of the present invention. Removal of the image formation layer can be carried out by washing with water, and also carried out by supplying dampening water and/or printing ink to the image formation layer on a press (so-called on-press development).

The developing treatment on a printing press means that removal of the image formation layer at unexposed portions is carried out on a press. A dampening roller and an inking roller are also brought into contact with the image formation layer while rotating the plate cylinder, to be carried out according to various sequences such as those described below or another appropriate sequence. The supplied amount of dampening water may be adjusted to be greater or smaller than the amount ordinarily supplied in printing, and the adjustment may be carried out stepwise or continuously.

(1) A dampening roller is brought into contact with the image formation layer of a printing plate material on the plate cylinder during one to several tens of rotations of the plate cylinder, and then an inking roller brought into contact with the image formation layer during the next one to tens of rotations of the plate cylinder. Thereafter, printing is carried out.

(2) An inking roller is brought into contact with the image formation layer of a printing plate material on the plate cylinder during one to several tens of rotations of the plate cylinder, and then a dampening roller brought into contact with the image formation layer during the next one to tens of rotations of the plate cylinder. Thereafter, printing is carried out.

(3) An inking roller and a dampening roller are brought into contact with the image formation layer of a printing plate material on the plate cylinder during one to several tens of rotations of the plate cylinder. Thereafter, printing is carried out.

EXAMPLE

Next, the present invention will now be described in detail referring to examples, however, the present invention is not limited thereto. In the examples, "parts" is parts by weight, unless otherwise specified.

Preparation of Support

A 0.24 mm thick aluminum plate (1050, H16) was immersed in 1% by weight of an aqueous sodium hydroxide solution at 50° C. to give an aluminum dissolution amount of 2 g/m$^2$, washed with water, immersed in 5% by weight of an aqueous nitric acid solution at 25° C. for 30 seconds to neutralize, and then washed with water.

Subsequently, the aluminum plate was subjected to an electrolytic surface-roughening treatment in an electrolytic solution containing 11 g/liter of hydrochloric acid and 1.5 g/liter of aluminum at a peak current density of 80 A/dm$^2$ employing an alternating current with a sine waveform, in which the distance between the plate surface and the electrode was 10 mm. The electrolytic surface-roughening treatment was divided into 4 treatments, in which the quantity of electricity used in one treatment (at a positive polarity) was 50 C/dm$^2$, and the total quantity of electricity used (at a positive polarity) was 200 C/dm$^2$. Standby time of 4 seconds, during which no surface-roughening treatment was carried out, was provided after each separate electrolytic surface-roughening treatment.

Subsequently, the resulting aluminum plate was immersed in 10% by weight of an aqueous phosphoric acid solution at 50° C. and etched to give an aluminum etching amount (including smut produced on the surface) of 0.6 g/m$^2$ , and washed with water. Next, the aluminum plate was subjected to anodizing treatment in 20% by weight of an aqueous sulfuric acid solution at a current density of 4 A/dm$^2$ so as to form an anodization film of 2.5 g/m$^2$, and washed with water.

The washed surface of the plate was squeegeed, and the plate was immersed in 0.5% by weight of an aqueous sodium dihydrogen phosphate solution at 70° C. for 15 seconds, washed with water, and dried at 80° C. for 5 minutes to obtain a support. Surface roughness Ra of the support was 0.27 nm.

(Measuring Method of Surface Roughness)

A platinum-rhodium layer with a thickness of 1.5 nm are vacuum-deposited onto a sample surface, and surface roughness is measured under the condition of a magnification of 20, employing a non-contact three dimensional surface roughness measuring device RST plus produced by WYKO Co., Ltd., (in which the measurement area is 222.4 μm×299.4 μm). The resulting measurement is subjected to slope correction and to filtering treatment of Median Smoothing. Five portions of each sample are measured and the average of the measurements is defined as surface roughness Ra of the sample.

(Preparation of Aqueous Dye Precursor Coated Particle Dispersion and Preparation of Aqueous Color Developing Agent Coated Particle Dispersion)

Preparation of Aqueous Dye Precursor Coated Particle Dispersion [1]

Ten parts by weight of a MEK (methylethylketone) solution containing 5% by weight of an electron providing dye precursor 2-(4-methylanilino)-3-methyl-6-ethylaminofluoran (black coloring) were dripped into 90 parts by weight of styrene acrylic polymer particle emulsion (Tg: 100° C., average particle diameter: 80 nm, and solid content: 5% by weight) for 5 minutes while stirring.

Next, the resulting was heated to 50° C., the MEK was removed by reducing the pressure to adjust the solid content so as to be 5% by weight via addition of pure water. This gives aqueous dispersion [1] of particles in which a dye precursor was coated on at least a part of the surface of the styrene acrylic polymer particle.

Preparation of Aqueous Color Developing Agent Coated Particle Dispersion [2]

Fifteen parts by weight of an IPA (isopropanol) solution containing 5% by weight of an electron accepting color developing agent D-8 (4-hydroxy-4'-isopropoxydiphenylsulfone, produced by Nippon Soda Co., Ltd.) were dripped into 85 parts by weight of styrene acrylic polymer particle emulsion (Tg: 100° C., average particle diameter: 80 nm, and solid content: 5% by weight) for 5 minutes while stirring. Next, the resulting was heated to 50° C., the IPA was removed by reducing the pressure to adjust the solid content so as to be 5% by weight via addition of pure water. This gives aqueous dispersion [2] of particles in which a color developing agent was coated on at least a part of the surface of the styrene acrylic polymer particle.

Preparation of Aqueous Complex Coated Particle Dispersion [3]

Twenty parts by weight of an IPA solution containing 2.5% by weight of following infrared absorbing dye 1 were dripped into 90 parts by weight of aqueous dispersion [1] for 5 minutes while stirring. Next, the resulting was heated to 50° C., the IPA was removed by reducing the pressure to adjust the solid content so as to be 5% by weight via addition of pure water. This gives aqueous dispersion [3] of particles in which a dye precursor was coated on at least a part of the surface of the styrene acrylic polymer particle, and infrared absorbing dye 1 was further coated on at least a part of the surface.

Infrared Absorbing Dye 1

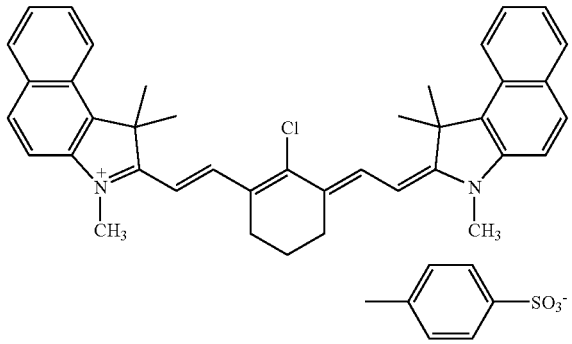

Preparation of Aqueous Complex Coated Particle Dispersion [4]

Twelve parts by weight of an IPA solution containing 5% by weight of foregoing color developing agent D-8 were dripped into 88 parts by weight of aqueous dispersion [3] for 5 minutes while stirring. Next, the resulting was heated to 50° C., the IPA was removed by reducing the pressure to adjust the solid content so as to be 5% by weight via addition of pure water. This gives aqueous dispersion [4] of particles in which a dye precursor was coated on at least a part of the surface of the styrene acrylic polymer particle, infrared absorbing dye 1 was further coated on at least a part of the surface, and also a developing agent was further coated on at least a part of the surface. No black coloring of particles was observed since infrared absorbing dye 1 served as a barrier layer in this case.

(Preparation of Aqueous Dye Precursor Dispersion and Preparation of Aqueous Color Developing Agent Dispersion)

Preparation of Aqueous Dye Precursor Particle Dispersion [5]

Eighteen grams of electron providing dye precursor 2-(4-methylanilino)-3-methyl-6-ethylaminofluoran, 50 g of an aqueous 4% by weight carboxymethylcellulose (CMC 1220, produced by Daicel Chemical Co., Ltd.) solution and 32 g of pure water were mixed, and dispersed in a sand grinder for 5 hours.

Zirconia beads were used as a dispersant, and the number of rotation for dispersion was 1500 rpm.

One hundred grams of pure water were added to the mixture for dilution, and mixed for 10 minutes at 500 rpm. Thereafter, the beads were removed to obtain an aqueous electron providing dye precursor particle dispersion [5] having a solid content of 10% by weight.

The average particle diameter of the electron providing dye precursor particles was 1.0 μm.

Preparation of Aqueous Color Developing Agent Particle Dispersion [6]

Aqueous electron accepting color developing agent particle dispersion [6] was prepared in the same manner as in the aqueous electron providing dye precursor particle dispersion, except that the aqueous electron providing dye precursor was replaced by electron accepting color developing agent D-8 4-hydroxy-4'-isopropoxydiphenylsulfone (produced by Nippon Soda Co., Ltd.), and the dispersion time was set to 3 hours.

The average particle diameter of the electron accepting color developing agent particles was 1.2 μm.

Preparation of Printing Plate Material

Preparation of Thermosensitive Image Formation Layer Coating Solution

The material of each composition shown in Table 1 was sufficiently mixed while stirring, and filtered to obtain thermosensitive image formation layer coating solutions (1) -(6) with a solid content of 4% by weight.

Compositions of thermosensitive image formation layer coating solutions (1)-(6) (In Table 1, numerical values indicate parts by weight unless otherwise specified.).

TABLE 1

| | Thermosensitive image formation layer coating solution No. | | | | | |
|---|---|---|---|---|---|---|
| Material | (1) | (2) | (3) | (4) | (5) | (6) |
| Styrene acrylic polymer particle emulsion (Tg: 100 ° C., average particle diameter: 80 nm and solid content: 5% by weight) | | | | | 3.00 | 2.50 |
| Aqueous infrared absorbing dye 2 1% by weight solution | 32.00 | 32.00 | | | 2.00 | 2.00 |
| Aqueous sodium polyacrylic acid solution (Molecular weight: 250,000 and solid content: 25% by weight) | 1.92 | 1.92 | 1.92 | 1.92 | 0.12 | 0.12 |
| Aqueous dispersion [1] | 56.00 | | | | | |
| Aqueous dispersion [2] | | 57.60 | | | | |
| Aqueous dispersion [3] | | | 62.40 | | | |
| Aqueous dispersion [4] | | | | 70.40 | | |
| Aqueous dispersion [5] | | 6.40 | | | 0.40 | 0.60 |
| Aqueous dispersion [6] | 8.00 | | 8.00 | | 0.60 | 0.90 |
| Pure water | 2.08 | 2.08 | 27.68 | 27.68 | 3.88 | 3.88 |

(In Table 1, numerical values indicate parts by weight unless otherwise specified.)

Infrared Absorbing Dye 2

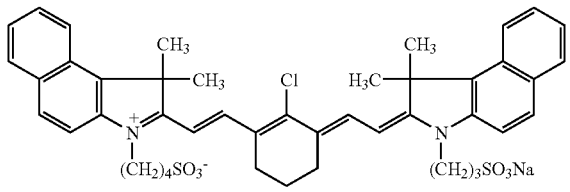

Preparation of Printing Plate Material Samples 1-6

Each of thermosensitive image formation layer coating solutions (1)-(6) was coated on the grained support surface employing a wire bar, and dried at 55° C. for 3 minutes. In this case, a dry coating amount of the thermosensitive image formation layer was adjusted so as to give 1.0 g/m$^2$. Thereafter, aging treatment was conducted to the resulting at 40° C. for 24 hours to obtain printing plate material samples 1-6.

A coating amount of a dye precursor in a thermosensitive image formation layer for each printing plate material was indicated in Table 2.

(Image Formation Employing Infrared Laser)

Each of the resulting printing plate material samples was mounted and fixed on an exposure drum. Exposure was carried out using an infrared laser beam having a wavelength of 830 nm and a beam spot diameter of 18 μm at a resolution of 2400 dpi ("dpi" herein shows the number of dots per 2.54 cm) and at a screen line number of 175 to record an image. The recorded images include a solid image and a halftone (dot) image with a dot density of 1-99%. The value of exposure energy was set to 250 mJ/cm$^2$.

(Printing Method)

Printing was carried out employing a printing press, DAIYA 1F-1 produced by Mitsubishi Heavy Industries, Ltd., and employing a coated paper, a dampening water of 2% by weight solution of Astromark 3 (produced by Nikken Kagaku Kenkyusyo Co., Ltd.), and printing ink (Toyo King Hy-Unity M Magenta, produced by Toyo Ink Manufacturing Co., Ltd.).

Each of the exposed printing plate material samples was mounted on a plate cylinder of the printing press, and printing was carried out in the same printing condition with an initial printing sequence to start printing as in the case of a conventional PS plate, and printing up to 20000 paper sheets was conducted.

(Exposure Visualization Property)

Density difference between an unexposed portion and a solid image portion was measured employing a reflectance densitometer D-196 (produced by GretagMacbeth Ltd.). Black density ($D_B$) specified in the reflectance densitometer D-196, based on the reference white was measured to determine density difference as an indication of an exposure visualization property.

The results are shown in Table 2.

Evaluation of Printability (Initial Printability)

The number of paper sheets printed before obtaining a good image print from the start of printing was determined as an indication of on-press developability. A good image means a solid image with a density of at least 1.5 showing no stain in non-image area. The results are shown in Table 2.

(Printing Durability)

The printed image was observed in every 1000th print to check lack of dots at 3% dot image and an image deterioration level of a solid image portion. One observed earlier of either when uneven image density was visually observed at the solid image portion, or when lack of dots at the 3% dot image was observed was set to a printing durability end-point, and the number of prints was determined as an indication of printing durability. The results are shown in Table 2.

As is clear from Table 2, it is to be understood that the printing plate material of the present invention exhibits excellent exposure visualization, accompanied with excellent on-press developability and printing durability.

TABLE 2

| Printing plate material No. | Thermosensitive image formation layer coating solution No. | Dye precursor coating amount (g/m$^2$) | Exposure visualization property (Density difference) | *1 | Printing durability (Number of sheets) | |
|---|---|---|---|---|---|---|
| 1 | (1) | 0.070 | 0.55 | 20 | >20000 | Inv. |
| 2 | (2) | 0.072 | 0.50 | 20 | >20000 | Inv. |
| 3 | (3) | 0.070 | 0.58 | 20 | >20000 | Inv. |
| 4 | (4) | 0.070 | 0.55 | 20 | >20000 | Inv. |
| 5 | (5) | 0.072 | 0.35 | 20 | 18000 | Comp. |
| 6 | (6) | 0.108 | 0.48 | 25 | 10000 | Comp. |

*1: Initial printability (Number of sheets)
Inv.: Present invention
Comp.: Comparative example Effect of the Invention In the present invention, provided can be an image formation material exhibiting exposure visualization with excellent color development, and further provided can be a printing plate material exhibiting excellent on-press developability, accompanied with excellent exposure visualization and printing durability.

What is claimed is:

1. An image formation material comprising a support and provided thereon, a thermosensitive image formation layer, wherein the thermosensitive image formation layer comprises water-insoluble particle (A), electron providing dye precursor (B) and electron accepting dye color developing agent (C), and at least one of the precursor (B) and the color developing agent (C) is provided on a surface of the particle (A), wherein the particle (A) is a thermoplastic resin particle.

2. The image formation material of claim 1, wherein the precursor (B) is provided on the surface of the particle (A) and the color developing agent (C) is further provided on a surface of the precursor (B), or the color developing agent (C) is provided on the surface of the particle (A) and the precursor (B) is further provided on a surface of the color developing agent (C).

3. The image formation material of claim 2, wherein the particle (A) further has a barrier layer provided between the precursor (B) and the color developing agent (C).

4. The image formation material of claim 1, wherein the image formation material comprises a layer containing a light-to-heat conversion material on a side of the thermosensitive image formation layer provided on the support.

5. The image formation material of claim 1, wherein the support has a hydrophilic surface, and the image formation material is a printing plate material.

* * * * *

UNITED STATES PATENT AND TRADEMARK OFFICE

CERTIFICATE OF CORRECTION

PATENT NO. : 7,618,921 B2
APPLICATION NO. : 11/526777
DATED : November 17, 2009
INVENTOR(S) : Takahiro Mori It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 495 days.

Signed and Sealed this

Fourteenth Day of December, 2010

David J. Kappos

David J. Kappos
*Director of the United States Patent and Trademark Office*